US005458790A

United States Patent [19]

Cane et al.

[11] Patent Number: 5,458,790

[45] Date of Patent: Oct. 17, 1995

[54] ALKALINE EARTH METAL HYDROCARBYL SALICYLATE CONCENTRATES, THEIR PREPARATION AND USE

[75] Inventors: Charles Cane; Stephen J. Cook, both of North Humberside, United Kingdom

[73] Assignee: BP Chemicals (Additives) Limited, London, England

[21] Appl. No.: 355,171

[22] Filed: Dec. 8, 1994

[30] Foreign Application Priority Data

Dec. 8, 1993 [GB] United Kingdom ..... 9325133

[51] Int. Cl.[6] ..... C10M 159/20; C10M 159/22

[52] U.S. Cl. ..... 252/18; 252/39; 252/49.6

[58] Field of Search ..... 252/18, 39

[56] References Cited

U.S. PATENT DOCUMENTS

| | | | |
|---|---|---|---|
| 4,627,928 | 12/1986 | Karn | 252/39 |
| 4,719,023 | 1/1988 | MacPhail et al. | 252/39 |
| 4,876,020 | 10/1989 | Zon et al. | 252/39 |
| 5,162,085 | 11/1992 | Cane et al. | 252/39 |
| 5,281,345 | 1/1994 | Crawford et al. | 252/39 |
| 5,380,508 | 1/1995 | Inoue | 252/39 |

FOREIGN PATENT DOCUMENTS

| | | |
|---|---|---|
| 0294944 | 12/1988 | European Pat. Off. . |
| 0351052 | 1/1990 | European Pat. Off. . |

*Primary Examiner*—Ellen M. McAvoy
*Attorney, Agent, or Firm*—Nixon & Vanderhye

[57] ABSTRACT

An additive concentrate having a TBN greater than 300 suitable for incorporation into a finished lubricating oil comprises: (I) a lubricating oil soluble overbased alkaline earth metal hydrocarbyl salicylate modified by reaction to incorporate (a) an aldehyde, and (b) from 2 to 40% by weight, based on the weight of the concentrate, of either (i) at least one carboxylic acid having the formula:

$$R^3-\underset{\underset{R^4}{|}}{CH}-COOH \qquad (I)$$

wherein $R^3$ is a $C_{10}$ to $C_{24}$ alkyl or alkenyl group and $R^4$ is either hydrogen, a $C_1$ to $C_4$ alkyl group or a $CH_2COOH$ group, or an anhydride or ester thereof, or (ii) a di- or poly-carboxylic acid containing from 36 to 100 carbon atoms or an acid anhydride, acid chloride or ester thereof, and (II) a lubricating oil.

11 Claims, No Drawings

ALKALINE EARTH METAL HYDROCARBYL SALICYLATE CONCENTRATES, THEIR PREPARATION AND USE

The present invention relates to a process for the production of, and compositions comprising, a lubricating oil additive concentrate containing alkaline earth metal hydrocarbyl-substituted salicylates.

In the internal combustion engine, by-products from the combustion chamber often blow by the piston and admix with the lubricating oil. Many of these by-products form acidic materials within the lubricating oil.

One class of compounds generally employed to neutralise the acidic materials and disperse sludge within the lubricating oil are the metal hydrocarbyl-substituted salicylates, wherein the metal is an alkaline earth metal such as calcium, magnesium or barium. Both "normal" and "overbased" alkaline earth metal hydrocarbyl-substituted salicylates have been employed. The term "overbased" is used to describe those alkaline earth metal hydrocarbyl-substituted salicylates in which the ratio of the number of equivalents of the alkaline earth metal moiety to the number of equivalents of the salicylate moiety is greater than one, and is usually greater than 1.2 and may be as high as 4.5 or greater. In contrast, the equivalent ratio of alkaline earth metal moiety to salicylate moiety in "normal" alkaline earth metal hydrocarbyl-substituted salicylates is one. Thus, the "overbased" material usually contains greater than 20% in excess of the alkaline earth metal present in the corresponding "normal" material.

For this reason "overbased" alkaline earth metal hydrocarbyl-substituted salicylates have a greater capability for neutralising acidic matter than do the corresponding "normal" alkaline earth metal hydrocarbyl substituted salicylates.

Recently, attention has focussed on the production of highly overbased alkaline earth metal hydrocarbyl-substituted salicylates.

Thus our European application publication No. 0351052 discloses a process for the production of a lubricating oil additive concentrate having a TBN greater than 300 which process comprises reacting at elevated temperature component (A) at least one compound which is (i) an alkaline earth metal hydrocarbyl-substituted salicylate, (ii) a hydrocarbyl-substituted salicylic acid, (iii) an alkaline earth metal hydrocarbyl-substituted salicylate and a source of sulphur, (iv) a hydrocarbyl-substituted salicylic acid and a source of sulphur, (v) an alkaline earth metal sulphurised hydrocarbyl-substituted salicylate, or (vi) a sulphurised hydrocarbyl-substituted salicylic acid, component (B) an alkaline earth metal base added either in a single addition or in a plurality of additions at intermediate points during the reaction, component (C) at least one compound which is (i) water, (ii) a polyhydric alcohol having 2 to 4 carbon atoms, (iii) a di- ($C_3$ or $C_4$) glycol, (iv) a tri- ($C_2$–$C_4$) glycol, (v) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ ketone, (vii) a $C_1$ to $C_{10}$ carboxylic acid ester, or (viii) a $C_1$ to $C_{20}$ ether, component (D) a lubricating oil, component (E) carbon dioxide added subsequent to the, or each, addition of component (B), component (F) sufficient to provide from 2 to 40% by weight, based on the weight of the concentrate, of at least one compound which is (i) a carboxylic acid or an acid anhydride, acid chloride or ester thereof, said acid having the formula (II)

$$R^3-\underset{\underset{R^4}{|}}{CH}-COOH \quad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, or (ii) a di- or polycarboxylic acid containing from 36 to 100 carbon atoms or an acid anhydride, acid chloride or ester thereof, and component (G) at least one compound which is (i) an inorganic halide or (ii) an ammonium alkanoate or a mono-, di-, tri- or tetra-alkyl ammonium formate or alkanoate provided that, when component (G) is (ii), component (F) is not an acid chloride, the weight ratios of all components being such as to produce a concentrate having a TBN greater than 300.

The process of EP-A-0 351 052 facilitates the production of lubricating oil concentrates of alkaline earth metal hydrocarbyl-substituted salicylates having TBNs above 300, even above 350, and acceptable viscosities, that is viscosities at 100° C. of less than 1000 cSt, and even less than 500 cSt.

Although the publication teaches the use of a wide variety of starting materials, difficulty has been experienced in the production of the aforesaid concentrates from overbased alkaline earth metal hydrocarbyl salicylates having low TBNs, for example of about 60. In particular filtration rates consistent with operation of a commercial process have been difficult to achieve. In fact we have not found it possible to produce in a single step from these materials a concentrate having a TBN of about 400, for example, which will pass all the compatability tests.

We have now found that the solution to these problems is to react the overbased alkaline earth metal hydrocarbyl salicylate starting material, or its precursors, prior to overbasing further, with an aldehyde and, in particular formaldehyde in one or other of its physical forms.

The involvement of an aldehyde in the preparation of an alkaline earth metal salicylate salt is not unknown. Thus EP-A-0294944 discloses a method for the preparation of lubricant compositions including one or more lubricants and a polyvalent metal salt of formaldehyde condensation products of $C_{12}$–$C_{22}$ alkyl hydroxy benzoic acid, which method is characterised by:

(a) a step of preparation of monoalkyl phenol by alkylation of phenol with $C_{12}$–$C_{22}$ olefin under the presence of an ion-exchange resin as the catalyst for alkylation;

(b) a step of preparation of metal phenoxide by the addition of caustic alkali to the resultant reaction mixture containing monoalkyl phenol followed by removal of water produced as a by-product;

(c) a step of carboxylation by reaction of carbon dioxide with the metal phenoxide obtained in step (b) under pressure, followed by hydrolysis with addition of mineral acids to isolate and collect alkyl hydroxy benzoic acid;

(d) a step of condensation of the collected alkyl hydroxy benzoic acid with formaldehyde under the presence of a reaction promoter followed by isolation and removal of unreacted formaldehyde and reaction promoter; and (e) a step of preparation of alkali salt of the formaldehyde condensation products contained in the resultant solution by addition of caustic alkali and one or more lubricants, followed by conversion into the corresponding polyvalent metal salt by double decomposition with addition of polyvalent metal chlorides. The method includes the optional further step (e) for conversion of the resultant polyvalent metal salt into highly basic salt by the addition of an alcoholic suspension of polyvalent metal hydroxide and by the blowing of carbon dioxide gas into the resultant mixture.

EP-A-0294944 is not concerned with concentrates having a TBN greater than 300, the highest TBN disclosed therein being 180 and all the concentrates having a TBN in the range from 170–180.

Accordingly the present invention in one aspect provides an additive concentrate having a TBN greater than 300 suitable for incorporation into a finished lubricating oil comprising: (I) a lubricating oil soluble overbased alkaline earth metal hydrocarbyl salicylate modified by reaction to incorporate (a) an aldehyde, and (b) from 2 to 40% by weight, based on the weight of the concentrate, of either (i) at least one carboxylic acid having the formula:

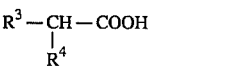

$$R^3-\underset{\underset{R^4}{|}}{CH}-COOH \qquad (I)$$

wherein $R^3$ is a $C_{10}$ to $C_{24}$ alkyl or alkenyl group and $R^4$ is either hydrogen, a $C_1$ to $C_4$ alkyl group or a $—CH_2COOH$ group, or an anhydride or ester thereof, or (ii) a di- or poly-carboxylic acid containing from 36 to 100 carbon atoms or an anhydride or ester thereof, and (II) a lubricating oil.

Preferably the aldehyde is incorporated into the lubricating oil soluble overbased alkaline earth metal hydrocarbyl salicylate by reacting an alkaline earth metal hydrocarbyl salicylate of lower TBN with the aldehyde prior to overbasing.

Preferably the TBN of the concentrate is greater than 350, more preferably greater than 400.

Suitably the concentrate may have a viscosity as measured at 100° C. of less than 1000 $mm^2\ S^{-1}$ (cSt), more preferably less than 500 $mm^2\ S^{-1}$ (cSt).

The aldehyde with which the alkaline earth metal hydrocarbyl salicylate is modified by reaction may be any of a variety of aldehydes including, for example, formaldehyde, propionaldehyde and butyraldehyde. The preferred aldehyde is formaldehyde. Formaldehyde may be reacted in any of its physical forms but it is preferred to use either paraformaldehyde or aqueous formaldehyde (formalin), of which formalin is more preferred. It is believed, though we do not wish to be held in any way to the belief, that reaction of a hydrocarbyl salicylate or a hydrocarbyl salicylic acid with an aldehyde results in the methylene bridging of at least two hydrocarbyl salicylate or salicylic acid molecules.

The alkaline earth metal is suitably either calcium, magnesium or barium, preferably calcium or barium, more preferably calcium. The hydrocarbyl substituent is suitably an aliphatic hydrocarbyl group, for example an alkyl or alkylene group, preferably an alkyl group which may be branched or unbranched. Suitable alkyl groups contain from 4 to 50, preferably from 9 to 28 carbon atoms. The substituent may typically be a $C_{12}$-hydrocarbon group derived from propylene tetramer.

The lubricating oil soluble overbased alkaline earth metal hydrocarbyl salicylate is modified by (b) from 2 to 40% by weight based on the weight of the concentrate of either (i) at least one carboxylic acid having the formula (I), or an anhydride or ester thereof, or (ii) a di- or poly-carboxylic acid containing from 36 to 100 carbon atoms, or an anhydride or ester thereof. As regards (i) with reference to the formula (I), $R^3$ is preferably an unbranched alkyl or alkenyl group. Preferred acids of formula (II) are those wherein $R^3$ is a $C_{10}$ to $C_{24}$, more preferably $C_{18}$ to $C_{24}$ unbranched alkyl group. Examples of suitable saturated carboxylic acids of formula (I) include capric, lauric, myristic, palmitic, stearic, isostearic, arachidic, behenic and lignoceric acids. Examples of suitable unsaturated acids of formula (II) include lauroleic, myristoleic, palmitoleic, oleic, gadoleic, erucic, ricinoleic, linoleic and linolenic acids. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example tall, cotton, soyabean, sunflower, herring and sardine oils and tallow. Sulphurised acids and acid mixtures may also be employed. Instead of, or in addition to, the carboxylic acid there may be used the acid anhydride. It is preferred however to use a carboxylic acid or a mixture of carboxylic acids. A preferred carboxylic acid of the formula (I) is stearic acid. As regards alternative (ii), this is preferably a polyisobutene succinic acid or a polyisobutene succinic anhydride. Of the alternatives (i) or (ii) it is preferred to incorporate (i), ie a carboxylic acid of the formula (I) or an anhydride or ester derivative thereof. The carboxylic acid having the formula (I), or its anhydride or ester derivative, or the di- or polycarboxylic acid or its anhydride or ester derivative is preferably incorporated in an amount of from 10 to 35%, eg 8 to 30%, more preferably 12 to 20%, for example 16%, by weight based on the weight of the concentrate.

The lubricating oil [component (II)] is suitably an animal oil, a vegetable oil or a mineral oil. Suitably the lubricating oil is a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tridecyladipate, or polymeric hydrocarbon lubricating oils, for example liquid polyisobutenes and polyalpha olefins. The lubricating oil may suitably comprise from 10 to 90%, typically from 30 to 90%, by weight based on the weight of the concentrate.

In a preferred embodiment there is provided an additive concentrate as hereinbefore described wherein the lubricating oil soluble overbased alkaline earth metal hydrocarbyl salicylate is modified by reaction before overbasing with an aldehyde and is derived from an alkaline earth metal hydrocarbyl salicylate of lower TBN, or its precursors, and wherein the amount of the lubricating oil (II') in the additive concentrate is such that the ratio of the weight of the additive concentrate to the weight of the lower TBN alkaline earth metal salicylate, or its precursors, from which the aldehyde-modified alkaline earth metal hydrocarbyl salicylate is derived is at least 3.0.

The amount of lubricating oil in the additive concentrate is such that the ratio of the weight of the additive concentrate to the weight of the alkaline earth metal hydrocarbyl salicylate of lower TBN, or its precursors, is at least 3.0, preferably at least 5.0, more preferably at least 10.0. An advantage of the high scale-up factor concentrates is that by reason of their higher lubricating oil concentration they are cheaper than the prior art concentrates of identical TBN.

If desired, the concentrate may be further modified by incorporation of boron, generally in the form of a borate salt. Boron may be present in the concentrate in an amount in the range from 0.1 to 10, preferably from 0.25 to 5 weight percent based on the weight of the concentrate.

In another aspect the present invention provides a process for the production of a lubricating oil additive concentrate as hereinbefore described which process comprises reacting at elevated temperature:

| | |
|---|---|
| component (A) | at least one compound which is (i) an alkaline earth metal hydrocarbyl salicylate, or (ii) a hydrocarbyl salicylic acid, |
| component (B) | an aldehyde, |
| component (C) | an alkaline earth metal base added either in a single addition or in a plurality of additions at intermediate points during the reaction, |
| component (D) | a solvent comprising either:- (1) either: (i) a polyhydric alcohol having 2 to 4 carbon atoms, (ii) a di- ($C_3$ or $C_4$) glycol, (iii) a tri- ($C_2$–$C_4$) glycol, or (iv) a mono- or poly-alkylene glycol alkyl ether of the formula:- $R(OR^1)xOR^2$ (II) wherein in the formula (I) R is a $C_1$ to $C_6$ alkyl group, $R^1$ is an alkylene group, $R^2$ is hydrogen or a $C_1$ to $C_6$ alkyl group and x is an integer of from 1 to 6, either alone or in combination with either (2) a hydrocarbon solvent or (3) either (a) water, (b) a $C_1$ to $C_{20}$ monohydric alcohol, (c) a ketone containing up to 20 carbon atoms, (d) a carboxylic acid ester containing up to 10 carbon atoms or (e) an aliphatic, alicyclic or aromatic ether containing up to 20 carbon atoms or, (4) a $C_1$ to $C_4$ monohydric alcohol in combination with a hydrocarbon solvent (2) |
| component (E) | a lubricating oil, |
| component (F) | carbon dioxide added subsequent to each addition of component (C), |
| component (G) | sufficient to provide from 2 to 40% by weight, based on the weight of the concentrate of either (i) a carboxylic acid of the formula (I):- $R^3-\underset{\underset{R^4}{\vert}}{CH}-COOH$ (I) wherein $R^3$ is a $C_{10}$ to $C_{24}$ alkyl or alkenyl group and $R^4$ is hydrogen, a $C_1$ to $C_4$ alkyl group or a $-CH_2COOH$ group, or an anhydride or ester thereof or (ii) a di- or polycarboxylic acid containing from 36 to 100 carbon atoms or, an anhydride or ester thereof, |
| optionally component (H) | a catalyst for the reaction of (F), and |
| optionally component (J) | a source of boron, |

wherein component (A) is reacted with component (B) before reaction with components (C) and (F).

As regards component (A), this is at least one compound which is (i) an alkaline earth metal hydrocarbyl salicylate, or (ii) a hydrocarbyl salicylic acid. In addition to the components A (i) or A (ii), there may be used in admixture therewith one or more of an alkaline earth metal hydrocarbyl phenate, or its precursors, an alkaline earth metal hydrocarbyl sulphonate, or its precursors, or an alkali metal hydrocarbyl napththenate, or its precursors. The hydrocarbyl substituent (or substituents) may suitably be an alkyl or alkenyl group, typically a $C_1$–$C_{12}$ alkyl group, for example a dodecyl group derived from propylene tetramer. The alkaline earth metal is preferably either calcium, magnesium or barium, more preferably calcium or barium, most preferably calcium.

Preferably component (A) is an alkaline earth metal hydrocarbyl salicylate, more preferably an overbased alkaline earth metal hydrocarbyl salicylate. Using an overbased salicylate it is possible to increase the TBN by a factor of between about 1.1 and 10, depending upon the TBN of the starting salicylate. It is an advantage of the process of the invention that alkaline earth metal hydrocarbyl salicylates having a low TBN, for example a TBN of less than 150, typically about 60, can be further overbased to concentrates having a TBN greater than 350, and even 390 or greater by a single base addition. Low TBN alkaline earth metal sulphurised hydrocarbyl salicylates and their preparation are well-known in the art. Many are commercially available materials. If desired, sulphurised alkaline earth metal hydrocarbyl salicylates or salicylic acids may be employed.

As regards component (B), this is an aldehyde. Suitable aldehydes are described hereinbefore in relation to the additive concentrate. The aldehyde may suitably be added in an amount sufficient to react with any hydrocarbyl salicylate present on at least a 1:1 basis. The reaction of (A) with (B) may suitably be accomplished at elevated temperature, suitably in the range from 30 to 120° C., typically from 50° to 100° C.

Component (C) is an alkaline earth metal base added either in a single addition or in a plurality of additions at intermediate points during the reaction. Preferably component (C) is added in a single addition. The alkaline earth metal is preferably calcium, magnesium or barium, more preferably calcium or barium, most preferably calcium. The base moiety may suitably be an oxide or a hydroxide, preferably the hydroxide. A calcium base may be added, for example, in the form of quick lime (CaO) or in the form of slaked lime ($Ca(OH)_2$), preferably in the form of slaked lime.

As regards the amount of component (C) to be added, this should be sufficient to achieve the desired TBN. For a given TBN the amount will be greater starting with component A (ii) than with component A (i) by the amount necessary to form the alkaline earth metal salt.

Component (D) is a solvent for the reactants. The solvent (D) may be either (D) (1) alone or in combination with either (D) (2) or (D) (3), or the solvent (D) may be (D) (4) in combination with (D) (2) wherein:

(D) (1) is either (i) a polyhydric alcohol having 2 to 4 carbon atoms, (ii) a di-($C_3$ or $C_4$) glycol, (iii) a tri- ($C_2$ to $C_4$) glycol or (iv) a mono- or poly-alkylene glycol alkyl ether of the formula:

$$R(OR^1)xOR^2 \quad \text{(II)}$$

wherein in the formula (II) R is a $C_1$ to $C_6$ alkyl group, $R^1$ is hydrogen or a $C_1$ to $C_6$ alkyl group and x is an integer from 1 to 6. Suitable compounds having the formula (II) include the monomethyl or dimethyl ethers of (a) ethylene glycol, (b) diethylene glycol, (c) triethylene glycol or (d) tetraethylene glycol. A suitable compound is methyl diglycol ($CH_3OCH_2CH_2OCH_2CH_2OH$). Mixtures of glycol ethers of formula (II) and glycols may also be employed. The polyhydric alcohol may suitably be either a dihydric alcohol, for example ethylene glycol or propylene glycol, or a trihydric alcohol, for example glycerol. The di-($C_3$ or $C_4$) glycol may suitably be dipropylene glycol, the tri- ($C_2$ to $C_4$) glycol may suitably be triethylene glycol. Preferably the component (D) (1) is either ethylene glycol or methyl diglycol. (D) (2) is a hydrocarbon solvent which may be aliphatic or aromatic. Examples of suitable hydrocarbons include toluene, xylene, naphtha and aliphatic paraffins, for example hexane, and cycloaliphatic paraffins. (D) (3) may be either (i) water, (ii) a $C_1$ to $C_{20}$ monohydric alcohol, (iii) a ketone having up to 20 carbon atoms, (iv) a carboxylic acid ester having up to 10 carbon atoms or (v) an aliphatic, alicyclic or aromatic ether having up to 20 carbon atoms. Examples are methanol, 2-ethyl hexanol, cyclohexanol, cyclohexanone, benzyl alcohol, ethyl acetate and acetophenone. (D) (4) may be a $C_1$ to $C_4$ monohydric alcohol, preferably methanol. Preferred solvents (D) comprise ethylene glycol, a mixture of ethylene glycol and 2-ethyl hexanol and a mixture of methanol and toluene.

Component (E) is a lubricating oil. Suitable lubricating oils are described hereinbefore in relation to the concentrate.

Component (F) is carbon dioxide added subsequent to each addition of component (C). Carbon dioxide may be added in the form of a gas or a solid, preferably in the form of a gas. In gaseous form it may suitably be blown through the reaction. In order to produce concentrates having a TBN greater than 300 it is necessary to employ carbon dioxide in the reaction. For the preparation of concentrates having a TBN below 300 it is not necessary, but nevertheless it is desirable to employ carbon dioxide in the process.

Component (G) is either (i) a carboxylic acid of the formula (I), or (ii) a di- or polycarboxylic acid containing from 36 to 100 carbon atoms or an acid anhydride or ester of either (i) or (ii). Suitable components (i) and (ii) are described hereinbefore in relation to the additive concentrate. Typically the amount of component (G) employed is sufficient to provide from 10 to 35%, more preferably 12 to 20%, for example 16% by weight based on the weight of the concentrate.

Optional component (H) is a catalyst. The catalyst may be either an inorganic compound or an organic compound, preferably an inorganic compound. Suitable inorganic compounds include hydrogen halides, metal halides, ammonium halides, metal alkanoates, ammonium alkanoates or a mono-, di-, tri- or tetra-alkyl ammonium formate or alkanoate. As regards the metal moiety of metal halides or metal alkanoates, this is suitably either zinc, aluminium, or an alkaline earth metal, for example calcium. A preferred metal moiety is calcium. As regards the halide moiety, the chloride is preferred. The alkanoate moiety is suitably a $C_2$ to $C_{10}$ alkanoate, preferably a $C_2$ to $C_4$ alkanoate, for example an acetate or propionate. When a substituted ammonium compound is used, it is preferably a tetra- ($C_1$ to $C_4$ alkyl) ammonium compound, especially a tetramethylammonium compound such as tetramethylammonium acetate. Examples of suitable catalysts include calcium chloride, ammonium chloride, calcium acetate, ammonium acetate, zinc acetate, and tetramethylammonium acetate. Suitably the amount of catalyst employed may be up to 2.0% wt/wt. The catalyst can facilitate the overbasing process and may have other benefits. Whilst it is preferred to use a catalyst in the production of concentrates in general it is particularly preferred to use component (H) in the production of concentrates having a TBN greater than 300.

Optional component (J) is a source of boron. As the source of boron there may suitably be used either a boric acid or an anhydride thereof. Examples thereof include orthoboric acid, metaboric acid, tetraboric acid and boric anhydride. Generally orthoboric acid is preferred. Borate salts and esters of boric acid may also be employed.

As regards the order of addition, component (A) is reacted with component (B) before reaction with components (C) and (F). For the reaction of component (A) with component (B) it is preferred to employ a catalyst. Suitable catalysts include both organic and inorganic bases. It will usually be found most convenient to use as the catalyst in the reaction of (A) with (B) an alkaline earth metal base identical with the base used as component (C). A preferred order of addition comprises in a first step reacting component (A) with component (B) in the presence of components (D) and (G) and a catalytic amount of component (C) to form an alkaline earth metal hydrocarbyl salicylate incorporating an aldehyde and thereafter in a subsequent step or steps reacting the salicylate with components (C) and (F). Component (E), the lubricating oil, may suitably be added with components (A) and (B). Provided it is present before the addition of component (F), the catalyst for the carbonation (component H) may be added at any point, suitably after completion of the first step. Using ethylene glycol as the component (D) a preferred order of addition is to add component (D) (ethylene glycol) before component (C) (the alkaline earth metal base).

Suitably the elevated temperature at which the process is operated may be a temperature in the range from 15° to 200° C., preferably from 50° to 175° C. The selection of the optimum temperature within the aforesaid range will depend to a large extent on the nature of the solvent employed.

At the conclusion of the reaction it is preferred to recover the concentrate as a solution in lubricating oil by separating off the solvent (D), for example by distillation at subatmospheric pressure.

Finally, it is preferred to separate off any insoluble matter, suitably by filtration or centrifugation, preferably by filtration.

It is an advantage of the process of the invention that it produces concentrates which are easily processable by reason of their low sediment content and good filterability.

According to a further aspect of the present invention, there is provided a finished lubricating oil composition which composition comprises a major proportion of a lubricating oil and a minor proportion of the additive concentrate as hereinbefore described.

The amount of additive concentrate present in the finished lubricating oil will depend on the nature of the final use. Thus, for marine lubricating oils the amount of additive concentrate present may suitably be sufficient to provide a TBN of 9 to 100 and for automobile engine lubricating oils the amount may suitably be sufficient to provide a TBN of 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

The invention will now be further illustrated by reference to the following Examples.

The term "TBN" is used to denote the Total Base Number in mg KOH/g as measured by the method of ASTM D2896. The viscosity was measured by the method of ASTM D445. In the Examples and Comparison Tests which follow the abbreviations $V_{100}$, $V_{40}$ and VI are employed. These represent the viscosity at 100° C., the viscosity at 40° C. and the viscosity Index respectively.

EXAMPLE 1

A slurry comprising:

| | |
|---|---|
| A commercially available 60 TBN calcium hydrocarbyl salicylate | 58 g |
| Ethylene glycol | 32 g |
| Paraformaldehyde | 6 g |
| Lime (as catalyst) | 10 g |

was heated to 145° C./21 inches Hg and held for 15 minutes, after which there was added:

| | |
|---|---|
| 2-Ethyl hexanol | 50 g |
| Calcium acetate | 6 g |
| Stearic acid | 63 g |

and the mixture was held at 145° C./11 inches Hg for 15 minutes before cooling to 100° C. and adding:

| | |
|---|---|
| 2-Ethyl hexanol | 100 g |
| Lime | 83 g |

The mixture was held at 130° C./11 inches Hg for 15 minutes, after which there was added at 130° C./11 inches Hg:

| | |
|---|---|
| Carbon dioxide | 51 g |

Thereafter solvents were removed by stripping at 210° C./10 mm Hg and the product was filtered.

Results

| | |
|---|---|
| Product weight | 410 g |
| Distillate weight | 198 g |
| Crude sediment | 1.0% v/v |
| Filtration rate | Very fast |
| Calcium content | 13.9% w/w |
| TBN | 390 mgKOH/g |
| $V_{100}$ | 699 cSt |
| $V_{40}$ | 11,933 cSt |
| VI | 245 |

This example demonstrates that a low TBN salicylate can be upgraded using a single lime addition to a high TBN salicylate by reacting the salicylate before overbasing with formaldehyde.

Comparison Test

| | |
|---|---|
| A commercially available 60 TBN calcium hydrocarbyl salicylate | 220 g |
| calcium acetate | 6 g |
| stearic acid | 63 g |
| 2-ethyl hexanol | 120 g |

was heated from 120° C. to 145° C./11" Hg whilst adding:

| | |
|---|---|
| ethylene glycol | 32 g |

The mixture was held at 145° C./11" Hg for 20 minutes and then cooled to 100° C. At this temperature there was added:

| | |
|---|---|
| lime | 64 g |

The mixture was held at 145° C./11" Hg for a further 20 minutes after which there was added at 145° C./1 bar:

| | |
|---|---|
| carbon dioxide | 30 g |

The next stage was to have been removal of the solvents at 210° C./10 mmHg prior to product filtration. However, during the solvent removal stage the product degraded into a very viscous grease.

This test demonstrates the difficulty that can be encountered in upgrading a low TBN salicylate in a single lime addition to a high TBN salicylate in the absence of formaldehyde.

EXAMPLE 2

A slurry comprising:

| | |
|---|---|
| A commercially available 185 TBN (7.8% Ca) overbased salicylate | 220 g |
| Lime (as catalyst) | 10 g |
| Lube oil | 100 g |
| Paraformaldehyde | 6 g |
| Glycol | 32 g |

was heated to 145° C./21" Hg and held for 15 minutes.

There was added:

| | |
|---|---|
| Stearic acid | 63 g |
| Calcium acetate | 6 g |
| 2-Ethyl hexanol | 50 g |

and the mixture was held at 145° C./11" Hg for 15 minutes.

There was then added:

| | |
|---|---|
| 2-Ethyl hexanol | 100 g |
| Lime | 95 g |

The mixture was held at 130° C./11" Hg before adding at 130° C./1 bar:

| | |
|---|---|
| Carbon dioxide | 110 g |

Solvents were then removed to 210° C./10 mm Hg and the cooled product was filtered.

Results

| | |
|---|---|
| Product weight | 524 g |
| Viscosity at 100° C. | 1014 $mm^2S^{-1}$ (cst) |
| Viscosity at 40° C. | 19,518 $mm^2S^{-1}$ (cst) |
| Viscosity Index | 255 |
| Calcium content | 13.8% (96% incorporation) |

-continued

| | |
|---|---|
| Suphur content | 220 ppm |
| Alkalinity value | 387 mg KOH/g |

EXAMPLE 3

A slurry comprising:

| | |
|---|---|
| A commercially available 60 TBN calcium hydrocarbyl salicylate | 220 g |
| Lime (as catalyst) | 10 g |
| Paraformaldehyde | 6 g |
| Ethylene glycol | 32 g |

was heated to and held at 145° C./21" Hg for 15 minutes after which there was added:

| | |
|---|---|
| 2-Ethyl hexanol | 50 g |
| Calcium acetate | 6 g |
| Stearic acid | 63 g |

The mixture was held at 145° C./11" Hg for 15 minutes and then cooled to 100° C. before adding:

| | |
|---|---|
| 2-Ethyl hexanol | 100 g |
| Lime | 83 g |

The mixture was held at 130° C./11" Hg for 15 minutes, after which there was added at 130° C./1 bar:

| | |
|---|---|
| Carbon dioxide | 51 g |

Solvents were then removed to 210° C./10 mm Hg and after cooling the product was filtered.

Results

| | |
|---|---|
| Product weight | 410 g |
| Distillate weight | 198 g |
| Crude sediment | 1.0% V/V |
| Filtration rate | Very fast |
| Calcium | 13.9% w/w |
| Sulphur | 0.2% w/w |
| TBN | 390 mg KOH/g |
| Viscosity at 100° C. | 699 $mm^2S^{-1}$ (cst) |
| Viscosity at 40° C. | 11,933 $mm^2S^{-1}$ (cst) |
| Viscosity Index | 245 |

EXAMPLE 4

The 390 TBN calcium salicylate concentrate produced in Example 3 was blended in HVI 50 base oil at 70 TBN and stored at room temperature, 80° C. and 150° C. The compatability of the blends was assessed after 2 and 7 days in terms of their appearance and sediment when subjected to a beam of transmitted light in an 'in house' test devised to determine the ability of an additive to form homogeneous solutions with base oil. The rating scheme employed is shown in Table 1.

The results are presented in Table 2.

Comparison Test 2

Example 4 was repeated except that instead of using the concentrate obtained in Example 3 there was used a commercially available overbased 280 TBN calcium salicylate.

The results are provided in Table 2.

With reference to Table 2 it is readily apparent that the high TBN calcium salicylate-containing aldehyde-modified concentrate of Example 3 is more compatible with base oil than the commercially available product after 7 days at 80° C. and 150° C.

TABLE 1

| RATING | | | |
|---|---|---|---|
| Appearance | | Sediment | |
| Rating | Description | Rating | Description |
| | | — | No sediment |
| 1 | Clear and bright | A | Just detectable |
| 2 | Slight cloud | B | Trace (wispy) |
| 3 | Moderate cloud | C | Up to 1.5 mm |
| 4 | Detectable floc | D | Up to 3.0 mm |
| 5 | Heavy floc | E | Up to 6.5 mm |
| 6 | Heavy cloud | F | Up to 13.0 mm |
| 7 | Light suspension | G | Up to 24.5 mm |
| 8 | Cotton wool suspension | H | Over 25.5 mm |

TABLE 2

| | Compatability Example | |
|---|---|---|
| | Example 4 | Comparison Test 2 |
| 2 Days | | |
| Room Temp. | 2/- | 2/- |
| 80° C. | 2/- | 2/B |
| 150° C. | 2/- | 2/- |
| 7 Days | | |
| Room Temp. | 2/- | 2/- |
| 80° C. | 2/- | 2/C |
| 150° C. | 2/- | 3/- |

We claim:

1. An additive concentrate having a TBN greater than 300 suitable for incorporation into a finished lubricating oil comprising: (I) a lubricating oil soluble overbased alkaline earth metal hydrocarbyl salicylate modified by reaction to incorporate (a) an aldehyde, and (b) from 2 to 40% by weight, based on the weight of the concentrate, of either (i) at least one carboxylic acid having the formula:

$$R^3-\underset{\underset{R^4}{|}}{CH}-COOH \qquad (I)$$

wherein $R^3$ is a $C_{10}$ to $C_{24}$ alkyl or alkenyl group and $R^4$ is either hydrogen, a $C_1$ to $C_4$ alkyl group or a $CH_2COOH$ group, or an anhydride or ester thereof, or (ii) a di- or poly-carboxylic acid containing from 36 to 100 carbon atoms or an acid anhydride, acid chloride or ester thereof, and (II) a lubricating oil.

2. An additive concentrate as claimed in claim 1 wherein the aldehyde is incorporated into the lubricating oil soluble overbased alkaline earth metal hydrocarbyl salicylate by reacting an alkaline earth metal hydrocarbyl salicylate of lower TBN with the aldehyde prior to overbasing.

3. An additive concentrate as claimed in claim 1 having a TBN greater than 350.

4. An additive concentrate as claimed in claim 1 claims wherein the viscosity as measured at 100° C. is less than 500 $mm^2s^{-1}$ (CSt).

5. An additive concentrate as claimed in claim 1 wherein the aldehyde which is incorporated is formaldehyde.

6. An additive concentrate as claimed in claim 1 incorporating at least one carboxylic acid having the formula (I).

7. An additive concentrate as claimed in claim 6 wherein the carboxylic acid having the formula (I) incorporated is stearic acid.

8. An additive concentrate as claimed in claim 6 wherein the carboxylic acid having the formula (I) is incorporated in an amount of from 10 to 35% by weight based on the weight of the concentrate.

9. An additive concentrate as claimed in claim 1 wherein the alkaline earth metal of the overbased alkaline earth metal hydrocarbyl salicylate is calcium.

10. A process for the production of a lubricating oil additive concentrate as hereinbefore described which process comprises reacting at elevated temperature:

| | |
|---|---|
| component (A) | at least one compound which is (i) an alkaline earth metal hydrocarbyl salicylate, or (ii) a hydrocarbyl salicylic acid, |
| component (B) | an aldehyde, |
| component (C) | an alkaline earth metal base added either in a single addition or in a plurality of additions at intermediate points during the reaction, |
| component (D) | a solvent comprising either:-<br>(1) either:<br>(i) a polyhydric alcohol having 2 to 4 carbon atoms,<br>(ii) a di- ($C_3$ or $C_4$) glycol,<br>(iii) a tri- ($C_2$–$C_4$) glycol, or<br>(iv) a mono- or poly-alkylene glycol alkyl ether of the formula:-<br>$R(OR^1)xOR^2$ (II)<br>wherein in the formula (I) R is a $C_1$ to $C_6$ alkyl group, $R^1$ is an alkylene group, $R^2$ is hydrogen or a $C_1$ to $C_6$ alkyl group and x is an integer of from 1 to 6, either alone or in combination with either (2) a hydrocarbon solvent or (3) either (a) water, (b) a $C_1$ to $C_{20}$ monohydric alcohol, (c) a ketone containing up to 20 carbon atoms, (d) a carboxylic acid ester containing up to 10 carbon atoms or (e) an aliphatic, alicyclic or aromatic ether containing up to 20 carbon atoms or, (4) a $C_1$ to $C_4$ monohydric alcohol in combination with a hydrocarbon solvent (2) |
| component (E) | a lubricating oil, |
| component (F) | carbon dioxide added subsequent to each addition of component (C), |
| component (G) | sufficient to provide from 2 to 40% by weight, based on the weight of the concentrate of either (i) a carboxylic acid of the formula (I):- |

$$R^3-\underset{\underset{R^4}{|}}{CH}-COOH \quad (I)$$

wherein $R^3$ is a $C_{10}$ to $C_{24}$ alkyl or alkenyl group and $R^4$ is hydrogen, a $C_1$ to $C_4$ alkyl group or a $-CH_2COOH$ group, or an anhydride or ester thereof or (ii) a di- or polycarboxylic acid containing from 36 to 100 carbon atoms or, an anhydride or ester thereof,

| | |
|---|---|
| optionally component (H) | a catalyst for the reaction of (F), and |
| optionally component (J) | a source of boron, |

wherein component (A) is reacted with component (B) before reaction with components (C) and (F).

11. A finished lubricating oil composition which composition comprises a major proportion of a lubricating oil and a minor proportion of the additive concentrate as claimed in claims 1.

* * * * *